United States Patent [19]

Grünwald et al.

[11] Patent Number: 4,692,657

[45] Date of Patent: Sep. 8, 1987

[54] SPARK PLUG FOR AN OTTO-TYPE INTERNAL COMBUSTION ENGINE

[75] Inventors: Werner Grünwald, Gerlingen; Kurt Schmid, Ditzingen-Schöckingen, both of Fed. Rep. of Germany

[73] Assignee: Robert Bosch GmbH, Stuttgart, Fed. Rep. of Germany

[21] Appl. No.: 808,333

[22] Filed: Feb. 28, 1986

[30] Foreign Application Priority Data

Dec. 18, 1984 [DE] Fed. Rep. of Germany ..... 3446128

[51] Int. Cl.[4] ..... H01T 13/20

[52] U.S. Cl. ..... 313/130; 313/144

[58] Field of Search ..... 313/130, 131 A, 141, 313/144

[56] References Cited

U.S. PATENT DOCUMENTS 2,265,352 12/1941 Corbin et al. ..... 313/141 X
2,900,547 8/1959 Engel ..... 313/130
4,539,503 9/1985 Esper et al. ..... 313/11.5

OTHER PUBLICATIONS

Bosch advertisement for "Platinum Spark Plug".
J. C. Whitney & Co cataloge; p. 172.

*Primary Examiner*—Palmer C. DeMeo
*Assistant Examiner*—Sandra L. O'Shea
*Attorney, Agent, or Firm*—Frishauf, Holtz, Goodman & Woodward

[57] ABSTRACT

To reduce erosion of a platinum-containing electrode layer (3, 14) applied to the end face of the center insulator (1, 11) of the spark plug, a protective layer of ceramic, preferably aluminum oxide, is applied over the electrode. The aluminum oxide protective is sufficiently thin to permit arc-through or spark-through of the spark from a counter electrode (9, 19). This permits reduction of the thickness of the electrode layer to between about 5 to 15 micrometers, preferably about 8 to 10 micrometers, with a thickness of the protective layer of between 5 to 50 micrometers, preferably about 8 to 10 micrometers. Aluminum oxide is the preferred material for the center insulator, the protective layer, as well as an additive to the center electrode if it is made of a mixture of platinum and ceramic.

8 Claims, 2 Drawing Figures

SPARK PLUG FOR AN OTTO-TYPE INTERNAL COMBUSTION ENGINE

Reference to related publications:

German Patent Disclosure Document No. DE-OS 31 32 903

U.S. Pat. No. 4,539,503;

U.S. Pat. No. 3,909,459.

The present invention relates to a spark plug for an internal combustion engine of the electrically ignited type, and more particularly to the center electrode construction thereof, in which the center electrode utilizes expensive noble metals.

BACKGROUND

It has previously been proposed to make the center electrode on a spark plug by applying a noble-metal suspension on the facing end of the center insulator of the spark plug. An electrical connection is made to the interior of the insulator and a therein-contained electrically conductive composition, for example an electrically conductive ceramic mass which is located in a longitudinal bore of the insulator. The electrically conductive mass may also include suspension of the noble metal. A spark plug of this type is described in the referenced German Patent Disclosure Document No. DE-OS 31 32 903.

The spark plug of the type described is extremely effective; due to the use of the noble metal, however, the spark plug is expensive. The layer of noble metal suspension which is located at the ignition end portion of the spark plug, exposed to the combustion gases and to the spark from a counter electrode, must be comparatively thick in order to insure sufficient lifetime of the spark plug. If the layer is too thin - which saves noble metal, typically platinum, too much of the noble metal is burned of upon sparking of the spark plug and the lifetime of the spark plug is impaired.

The noble metal coating at the facing end of the insulator can be applied by melt electrolysis, galvanic electrolysis, and even by brazing or welding a thin noble metal sheet on the insulator. Regardless of form, however, the requirement for noble metals in such a spark plug is high, so that the cost of the spark plug is also commensurately high.

THE INVENTION

It is an object to construct a spark plug, and especially the center electrode thereof, which has the advantage of noble metal at the sparking end without, however, requiring extensive amounts of noble metal, while providing for increased lifetime of such a spark plug with respect to the prior art.

Briefly, the center electrode of the spark plug is characterized by an electrode layer which comprises a metal or a metal-ceramic mixture applied to an end face of the end portion of the insulator, typically a platinum or platinum-ceramic layer fired on the insulator, which has applied thereover a ceramic protective layer covering the electrode layer. The ceramic protective layer is very thin—it has a thickness which permits spark discharge therethrough from a counter electrode.

Surprisingly, it has been found that applying an insulator over the counter electrode—which is contrary to the construction of spark gaps in general—permits use of a thin noble metal layer on the face of the spark plug, so that the use of noble metal on the spark plug can be substantially reduced. Additionally, the method of application of the noble metal to the tip of the spark plug insulator can be in accordance with well known and inexpensive processes, and the type of the electrode layer and the thickness thereof, permits good matching of heat characteristics of the layer and the underlying ceramic insulator.

In accordance with a preferred embodiment, the electrode layer is made of platinum or a mixture of platinum and aluminum oxide; the cover layer is aluminum oxide. Typical thicknesses for the electrode layer are between 5 to 15 micrometers; the protective layer may have a thickness of between 5 to 50 micrometers. Thicknesses of between about 8 to 10 micrometers, both for the electrode layer as well as for the protective layer, are particularly suitable.

DRAWINGS

FIG. 1 is a highly enlarged cross-sectional view through the insulator end and the sparkling tip portion of a spark plug center electrode, with the counter electrode shown only schematically; and FIG. 2 is a view similar to FIG. 1 and illustrating another embodiment.

DETAILED DESCRIPTION

Figure 1:
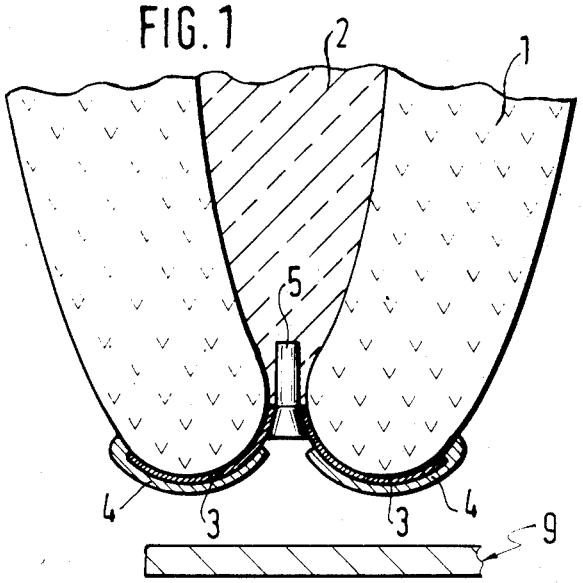

A hollow cylindrical insulating body 1—see FIG. 1—of aluminum oxide has, at the combustion end portion thereof, an electrode layer 3 of about 10 micrometer thickness applied thereto. The electrode layer 3 is a mixture of about 70% platinum and 30% aluminum oxide (both by volume). This layer is drawn within the interior hollow portion of the insulator 1 so that a contact pin 5, for example of nickel, will make electrical contact with the layer 3. The interior or hollow space within the insulator 1 is filled with an electrically conductive glass 2, which is in electrically conductive connection with the nickel pin 5.

In accordance with a feature of the invention, a protective layer 4 of aluminum oxide and of about 10 micrometer thickness covers the electrode layer 3 except for a small region which insures good electrical contact between the pin 5 and the electrode layer 3.

Further components standard in the industry and in the spark plug technology, such as a metal housing and the like, a terminal connection to the conductive glass 2, an insertion washer, and other components have been omitted since they can be in accordance with any well known and standard construction. The counter electrode 9 is shown in fragmentary form, not to scale, and should be considered only schematically.

Manufacture of the spark plug: The insulator 1 is preglowed at a temperature of between about 1100° to 1150° C. This temperature is below sintering temperature. The electrode 3 is then applied to the preglowed insulator, by dipping into a suitable suspension, by printing on the surface, or other suitable process. The layer 3 then is dried and thereafter the protective layer 4 is applied, for example again by dipping into a suspension, by printing over the layer 3, or other suitable process. Both layers 3, 4 are then sintered to the insulator 1 at a sintering temperature of between about 1500° to 1600° C.

The hollow interior body 1 then has the conductive glass 2 introduced therein, for example in form of a glass melt, flowed therein—as known, for example, from U.S. Pat. No. 3,909,459. The contact layer 5 is then pressed into the glass melt 2 from below. The contact layer 5, preferably, has a slightly inwardly tapering head which at least approximately matches the rounding of the insulator body 1 at the point where the pin 5 penetrates through the central opening thereof.

After the upper portion of the center electrode—not shown—is assembled, the subassembly is melted together at a suitable melt temperature, in dependence on the selected type of glass. Customary temperatures are between about 800° and 900° C. After cooling, the subassembly is assembled in a standard spark plug housing, on which the counter electrode 9 is already assembled, and the spark plug housing is gas-tightly peened or roller over a shoulder over the insulator body 1, as well known.

Experiments with spark plugs of this type have shown that, in spite of the comparatively thin layer 3, the combination of a layer 4, also very thin, with the layer 3 substantially increases the lifetime of the combined layers with respect to exposed noble-metal electrodes, and renders the spark plug comparable to standard spark plugs of mass production with a solid metal tip, that is, without using any noble metals.

Operation: Sparks between the noble metal layer 3 and the counter electrode 9 can readily penetrate and cut through the protective layer 4. No interference of the function of the protective layer has been found by repeated flash-through of the sparks between the counter electrode 9 and the noble-metal conductive layer 3. The electrode layer 3, even after extended use, has been found to be present, unimpaired in its function.

Figure 2:
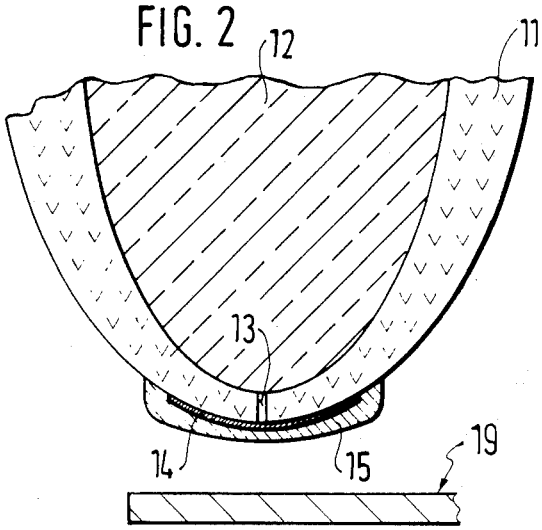

Embodiment of FIG. 2: The spark plug, shown again only in fragmentary form, in cross section of the tip, is constructed so that heat flow can be matched to the respective thermal loading within wide ranges, as described, for example, in detail in the referenced U.S. Pat. No. 4,539,503. This type of spark plug utilizes a ceramic insulating body, preferably made of aluminum oxide. The ceramic body is formed as a tube, closed at the bottom except for a small bore 13. The spark plug body 11 is a hollow, essentially closed tube, which is filled with a metal core 12 made, for example, of aluminum bronze. The metal core 12 has a substantially higher thermal coefficient of expansion than the insulator body 11. At temperatures below about 400° C., a narrow gap will form between the insulator 11 and the metal core 12. This gap has the effect that, at temperature below about 400° C., heat conduction from the insulator body 11 is poor. Consequently, the end portion of the insulator body facing the combustion chamber will heat rapidly. The end portion, thus, will burn off quickly any deposits which may have formed thereon. The bottom wall portion of the insulator body—which faces a counter electrode 19—is formed at the tip with the bore 13 which provides for electrical connection between the electrode layer 14 and the metallic core 12. The electrode layer 14 is applied, as in the preceding example, as a layer which covers the end cap or bowl of the aluminum oxide tubular body 11. The electrode layer again may have a thickness of about 10 micrometers, and, in accordance with the invention, is covered by a layer 15 of aluminum oxide of about 10 micrometer thickness. The opening 13 within the insulator body can be left free or, as well known, may be filled with an electrically conductive material (see, for example, the referenced U.S. Pat. No. 4,539,503).

The arrangement of FIG. 2 has the advantage that the spark will emanate from essentially the entire surface of the electrode layer 14, rather than from a single point. Manufacture of such a type of spark plug is known and need not be described in detail—see, for example, also the referenced U.S. Pat. No. 4,539,503. Layers 14, 15 can be applied as described in connection with the embodiment of FIG. 1, e.g. by dipping, printing on, or by painting on or by any other suitable and well known process.

The spark plugs, FIGS. 1 and 2, both have in common that the thickness of the electrode layer is very thin; the electrode layer, further, may be made of a mixture of platinum and a ceramic material, so that the overall noble-metal content of the electrode layer will be extremely low. Such layers, however, rapidly deteriorate in use. In accordance with the invention, the protective layer of such minimal thickness of between 5 to 50 micrometers and, preferably, in the order of only about 10 micrometers, so decreases the erosion of the electrode layer in use of the spark plug that the life of the spark plug becomes comparable to that of solid center electrode spark plugs. The erosion of electrode material, thus, is highly slowed by a protective layer of only about 10 micrometer thickness made, for example, of aluminum oxide. The operating characteristics of the spark plug are not impaired by this thin protective layer, since the spark can readily arc through the protective layer. The protective layer, however, retains its functional effect for a long time in spite of the arc-through or cut-through by the spark of the spark plug.

Various changes and modifications may be made within the scope of the inventive concept.

We claim:

1. A spark plug for an ignition system of an internal combustion engine having a rotation-symmetrical ceramic hollow support body (1, 11) of insulating, heat-resistant material;

a center electrode located at an end portion of said body;

and an electrically conductive material (2, 5; 12, 13) located within said hollow support body to establish an electrical connection with the ignition system, and electrically connected to the center electrode, wherein the center electrode comprises an electrode layer of platinum or a mixture of platinum and a ceramic material and of a thickness of between 5 to 15 micrometers applied to an end face of the end portion of said support body (1, 11) and a ceramic protective layer (4, 15) is provided, covering the electrode layer (3, 14), said ceramic protective layer (4, 15) having a thickness of between 5 to 10 micrometers.

2. A spark plug according to claim 1, wherein said electrode layer comprises a mixture of platinum and aluminum oxide.

3. A spark plug according to claim 1, wherein the electrode layer (3, 14) has a thickness of between about 8 to 10 micrometers, and the protective layer (4, 15) has a thickness of between 8 to 10 micrometers.

4. A spark plug according to claim 1, wherein the electrode layer comprises about 60% to 80% platinum and 40% to 20% aluminum oxide—percentages by volume.

5. A spark plug according to claim 2, wherein the electrode layer (3, 14) comprises a mixture of 60% to 80% and 40% to 20% aluminum oxide, by volume.

6. A spark plug according to claim 3, wherein the electrode layer (3, 14) has a thickness of between about 8 to 10 micrometers, and the protective layer (4, 15) has a thickness of between 8 to 10 micrometers.

7. A spark plug according to claim 1, wherein the ceramic protective layer (4, 15) has a thickness of between 8 to 10 micrometers.

8. A spark plug according to claim 1, wherein the ceramic of the rotation-symmetrical hollow body (1, 11) comprises aluminum oxide.

* * * * *